United States Patent [19]

Baker et al.

[11] 4,298,072

[45] Nov. 3, 1981

[54] CONTROL ARRANGEMENT FOR ELECTRO-MECHANICAL TOOL

[75] Inventors: Gordon P. Baker, Amelia; Thomas E. Warman, Williamsburg, both of Ohio

[73] Assignee: Senco Products, Inc., Cincinnati, Ohio

[21] Appl. No.: 71,721

[22] Filed: Aug. 31, 1979

[51] Int. Cl.[3] ..... B25C 1/06

[52] U.S. Cl. ..... 173/13; 173/15; 227/7; 227/131

[58] Field of Search ..... 200/61.58 R, 61.58 B; 227/5, 6, 7, 8, 131; 173/2, 13, 15

[56] References Cited

U.S. PATENT DOCUMENTS

| | | | |
|---|---|---|---|
| 3,612,379 | 10/1971 | Panock | 227/8 |
| 3,661,312 | 5/1972 | Pomernacki | 227/8 |
| 3,964,659 | 6/1976 | Eiben et al. | 227/7 X |
| 4,121,745 | 10/1978 | Smith et al. | 227/8 |
| 4,129,240 | 12/1978 | Geist | 227/8 |
| 4,204,622 | 5/1980 | Smith et al. | 227/7 |

*Primary Examiner*—Paul A. Bell

*Attorney, Agent, or Firm*—Frost & Jacobs

[57] ABSTRACT

A control arrangement for an electro-mechanical tool is disclosed. The tool may, for example, be a nailer or stapler, and is provided with an impact member which is frictionally moved in a working stroke by means of an electrically driven flywheel, which presses the impact member against the support element, which may be a counter-rotating flywheel. A solenoid is provided to move the impact member into the bite between the flywheel and support element. A trigger actuated switch and a safety switch actuated by contact of the tool with the workpiece must both be actuated in order to energize the solenoid. Circuitry is disclosed which makes possible the energization of the solenoid by closing both switches in any order, or in a desired particular order, and makes possible the provision of a time delay safety.

15 Claims, 4 Drawing Figures

CONTROL ARRANGEMENT FOR ELECTRO-MECHANICAL TOOL

CROSS REFERENCE TO RELATED APPLICATIONS

This application is related to an application in the names of James E. Smith and Carl T. Becht, Ser. No. 810,903 filed June 28, 1977, now U.S. Pat. No. 4,121,745 dated Oct. 24, 1978, and entitled "Electro-Mechanical Impact Device", and an application in the names of the said Smith and Becht, Ser. No. 880,448, filed Feb. 23, 1978 and entitled "Impact Device", now U.S. Pat. No. 4,189,808 dated Feb. 19, 1980, and an application in the names of James E. Smith and Gordon P. Baker, Ser. No. 06/073,030, filed Sept. 6, 1979 and entitled Configured Impact Member For Driven Fly Wheel Impact Device. The above mentioned patents and application are commonly assigned.

BRIEF SUMMARY OF THE INVENTION

In said U.S. Pat. No. 4,121,745 an impact tool was disclosed wherein the impact member was brought into contact between a pair of counter-rotating flywheels by action of the trigger. This was a mechanical action and means were provided to prevent actuation of the trigger unless the work responsive device was pressed against the work piece.

In said copending application, Ser. No. 880,448 a single flywheel was provided which cooperated with a support member, but again the arrangement for requiring the trigger to press the impact member into the bite between the flywheel and support member and the requirement that the tool be pressed against the work piece before the trigger could be actuated were the same as in said first mentioned copending application.

According to the present invention, the impact member is introduced between the flywheel and the support member (which may be counter-rotating flywheel) by the action of an electro-mechanical actuator such as a motor or a solenoid. An electrical switch is provided which is actuated by means of the trigger and this switch has two positions. When the trigger is actuated to a first position, the switch closes the circuit to the electric motor so that the electric motor begins to rotate. In the second position, when the trigger is fully depressed, the switch partially closes the circuit to the actuator.

A work responsive device moves the support member from its inactive position where its spacing from the flywheel is greater than the thickness of the impact device, to an operative position where its spacing is less than the thickness of the impact device and at the same time closes the safety switch which fully completes the circuit to the actuator, resulting in the actuator forcing the impact member into the bite between the support member and the flywheel. Spring means are provided to permit the impact member to enter between the support member and flywheel, while maintaining pressure on the impact member.

Further arrangements, including a logic circuit, make possible the operation of the tool by closing the switches in a particular order, or in any order, and may make provision for a time delay.

DETAILED DESCRIPTION

Figure 2:
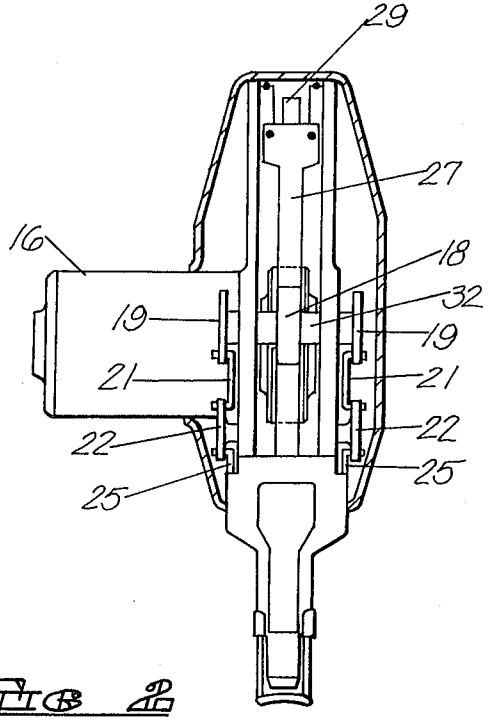
FIG. 2 is a front elevational view of the same with the front cover removed.
Figure 1:
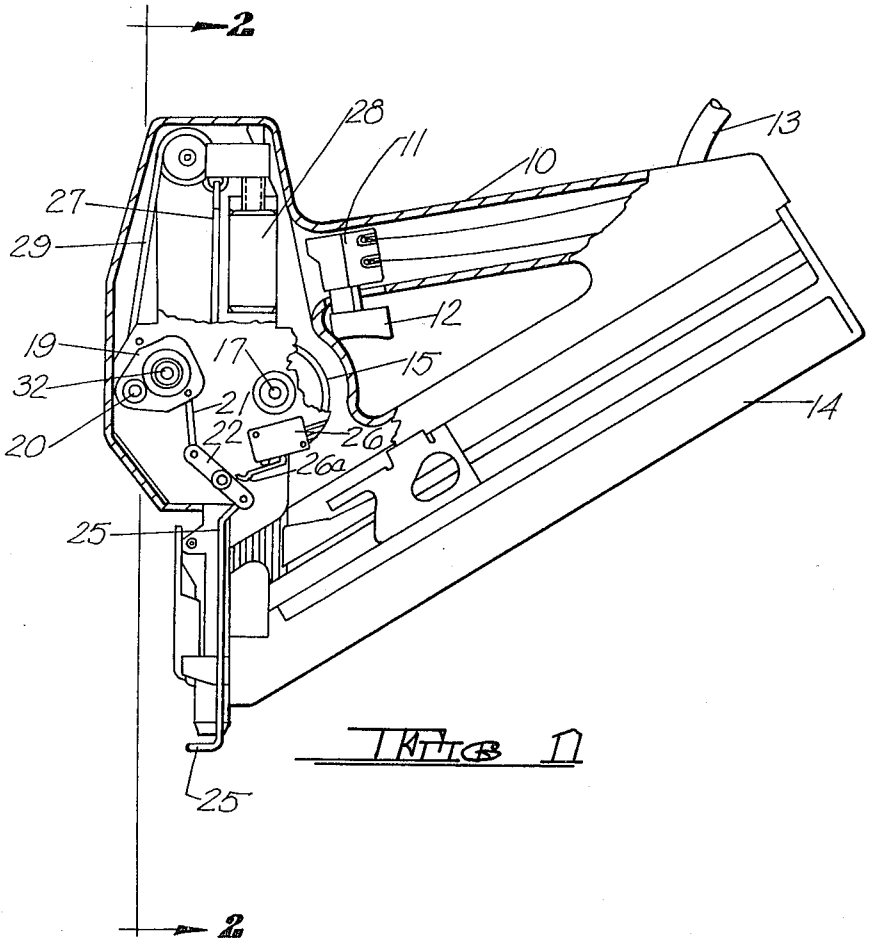
FIG. 1 is a side elevational view with parts in section of a tool according to the present invention.

The tool as shown in FIGS. 1 and 2 resembles in its general outlines the conventional nailer or stapler. It is provided with a handle element 10 which contains the trigger actuated switch 11, which is actuated by moving the trigger 12. The tool is connected by means of electrical wires 13 to a source of electrical energy. A magazine 14 is provided for nails or staples. The main housing contains a flywheel 15 actuated by an electric motor 16 which rotates about a fixed axis 17. A support element, which may be a smaller roller, 18 is mounted on axle 32 between the plates 19 which are pivoted at 20. Links 21 connect the plates 19 to the bell cranks 22 which are pivoted at 23. The bell cranks 22 are connected to the upper end of the work responsive safety device 25.

A safety switch is provided at 26 which is actuated by the bell crank 22.

It will be clear from what has been said above that when the tool is pressed against the work piece, the member 25 is moved upward as seen in FIGS. 1 and 2 and pivots the bell crank 22 counterclockwise. In so doing, it actuates the contact member **26*a* of the switch 26 and it also pulls the links 21 downward so as to rock the plates 19 clockwise about the pivot 20. This action moves the support element 18, which in this case is a small roller, to a position where its spacing from the periphery of the flywheel 15 is less than the thickness of the impact member 27. A solenoid is shown at 28 and an elastic member 29 connected to the impact member 27** serves to return the impact member to its uppermost position after the completion of a driving stroke.

Figure 3:
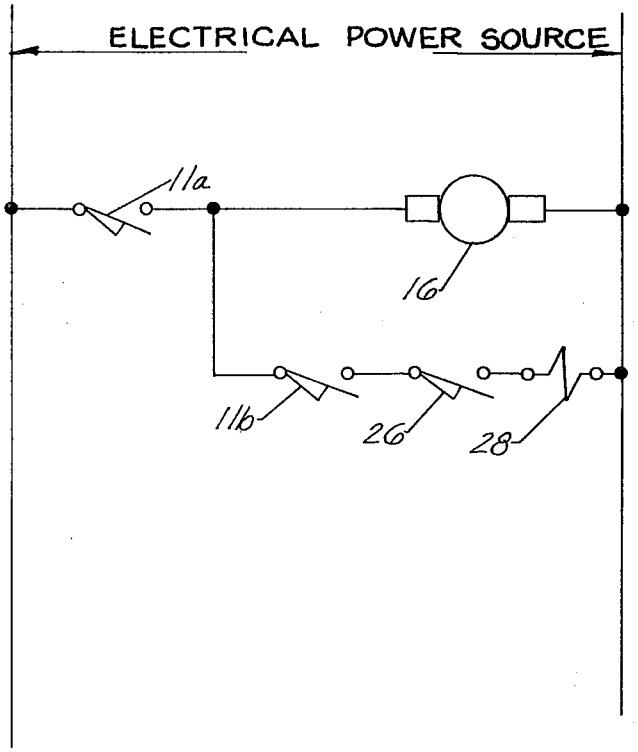
FIG. 3 is a simple circuit which provides for operation of the tool by concurrent actuation of two switches in either order.

Referring now to FIG. 3 which is a simple embodiment of the invention, it will be seen that when the tool is connected to a source of electrical power, the motor 16 may be energized by closing the switch **11*a***. This is accomplished by actuating the trigger switch to its first position.

Further actuation of the trigger to its second position closes the switch **11*b* and thus makes it possible when the tool is pressed against the work piece, thereby actuating the safety switch 26, for the solenoid 28 to operate and force the impact member 27 into the bite between the flywheel and support member. Axle 32 is designed to serve as a spring so that support element 18 can move to permit impact member 27 to enter between it and flywheel 15. The spring action of axle 32 serves to keep impact member 27 in frictional engagement with flywheel 15**.

Figure 4:
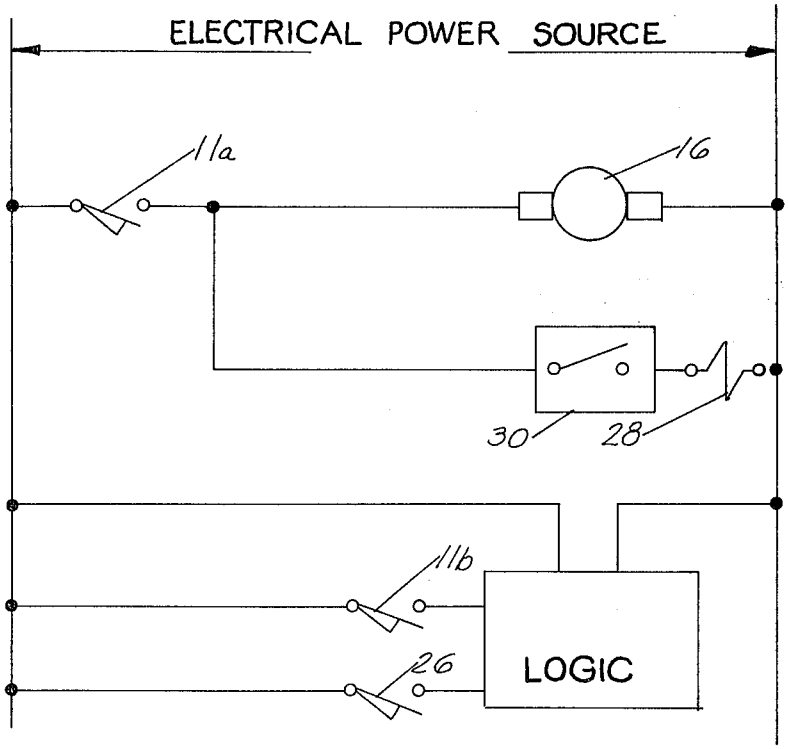
FIG. 4 shows a circuit including a logic device by means of which various modes of operation may be provided.

In FIG. 4, circuitry is disclosed which enables the device to be programmed for various modes of operation. For instance, the device may be programmed for operation upon actuation of the trigger switch and safety switch in any order, or upon actuation only in a particular order. In addition, the device may be programmed with a time delay safety whereby the device will operate only if actuation of the trigger switch is followed by actuation of the safety switch within a predetermined period of time (i.e. the device will operate only if the work responsive safety device is pressed against a work surface within five seconds of trigger actuation). Again the tool is energized by an electrical power source and again the trigger switch 11 is shown as having a first position 11*a* and a second position 11*b*, with the closing of the first position 11*a* energizing the motor 16. The safety switch 26 and the second position of the switch 11 at 11*b* constitute the inputs to a logic system, the output of which controls the switch 30. The logic system, as is well known to those skilled in the art, may be implemented with relays, discrete logic components, integrated circuit logic components, or mechanical logic components. The details will not be described because they in themselves do not constitute a part of the invention and the wiring for such logic is within the skill of the competent electrical engineer.

It will be understood that numerous modifications may be made without departing from the spirit of the invention. Therefore no limitation which is not specifically set forth in the claims is intended and no such limitation should be implied.

What we claim is:

1. An electric impact tool comprising an impact member, a manually actuated control means, a work responsive control means, an electric motor driven flywheel and a support element, said flywheel and said support element being positionable with respect to each other by a distance less than the thickness of said impact member, and a solenoid responsive to actuation of both said manually actuated and said work responsive control means, for introducing the impact member between the flywheel and support element when spaced from each other by a distance less than the thickness of said impact member.

2. An electric impact tool according to claim 1 wherein said work responsive control means comprises a work responsive switch actuated by a work contacting element arranged to move one of the flywheel and support element from an inoperative position in which the spacing therebetween is wider than the thickness of the impact member, to an operative position in which the spacing therebetween is less than the thickness of the impact member.

3. An electric impact tool according to claim 2 wherein said manually actuated control means comprises a manually actuated switch having a first position and a second position, said manually actuated switch in its first position energizing the electric motor, a logic circuit, said manually actuated switch in its second position and said work responsive switch together constituting inputs to said logic circuit, an electrical switch for energizing said solenoid when said electrical switch is closed, the output of said logic circuit controlling said electrical switch.

4. An electric impact tool according to claim 1 including means permitting at least one of the flywheel and support element to yield, with respect to the other, upon introduction of the impact member therebetween, to permit the impact member to pass between them while maintaining force against the impact member.

5. An electric impact tool according to claim 1 wherein means are provided to move said impact member in a work impacting direction selectively in response to actuation of said manually actuated and work responsive control means in at least one of a random order, a predetermined order, and a predetermined time limit.

6. An impact tool comprising (a) An impact member;

(b) An electrical motor driven flywheel and a support element positionable with respect to each other by a distance less than the thickness of the impact member;

(c) A solenoid for pushing the impact member into the bite between said flywheel and support element when spaced from each other by a distance less than the thickness of said impact member;

(d) Means permitting at least one of said flywheel and support element to yield with respect to the other to permit the impact member to pass therebetween, while maintaining force against the impact member;

(e) A manually actuated switch;

(f) A work responsive switch; and (g) Circuitry requiring said manually actuated switch and said work responsive switch to be concurrently actuated to energize said solenoid.

7. An impact tool for driving a fastening means into a workpiece comprising an impact member, an electric motor driven flywheel and a support element, one of said flywheel and said support element being shiftable between an inoperative position in which the spacing therebetween is wider than the thickness of said impact member and an operative position in which the spacing therebetween is less than the thickness of said impact member, a manually actuated control means, a workpiece responsive control means, and a solenoid responsive to actuation of both said workpiece responsive and manually actuated control means for introducing said impact member between said flywheel and said support element when spaced from each other by a distance less than the thickness of said impact member.

8. An impact tool according to claim 7 wherein said work responsive control means and said manually actuated control means comprise a work responsive switch and a manually actuated switch, respectively.

9. An impact tool according to claim 8 wherein said work responsive switch is actuated by a work contacting element, and said work contacting element is arranged to move one of said flywheel and support elements from said inoperative position in which the spacing therebetween is wider than the thickness of the impact member, to said operative position in which the spacing therebetween is less than the thickness of the impact member.

10. An impact tool according to claim 9 wherein said manually actuated switch comprises a trigger, and said switch has a first position and a second position, said switch in said first position energizing said motor, and in said second position partially completing a circuit to said solenoid, and said work responsive switch completes the circuit to said solenoid, and thereby prevents movement of said impact member by said solenoid unless said work contacting element is pressed against the work and said trigger is also actuated.

11. An impact tool according to claim 9 including means permitting at least one of the flywheel and support elements to yield, with respect to the other, upon introduction of the impact member therebetween, to permit the impact member to pass between them while maintaining force against the impact member.

12. An impact tool according to claim 8 wherein said manually actuated switch comprises a trigger and said manually actuated switch has a first position and a second position, said manually actuated switch in said first position energizing said motor, a logic circuit, said manually actuated switch in its second position and said work responsive switch together constituting inputs to said logic circuit, an electrical switch for energizing said solenoid when said electrical switch is closed, the output of said logic circuit controlling said electrical switch.

13. An impact tool according to claim 12 wherein said logic circuit is such that said solenoid is responsive to introduce the impact member between the flywheel and the support element only upon actuation of said manually actuated switch and said work responsive switch in a predetermined order.

14. An impact tool according to claim 12 wherein said logic circuit is such that said solenoid is responsive to introduce the impact member between the flywheel and the support element only upon actuation of a specific one of said manually actuated switch and said work responsive switch within a predetermined time following actuation of the other.

15. An impact tool according to claim 8 wherein said solenoid is responsive to introduce the impact member between the flywheel and the support element upon actuation of said manually actuated switch and said work responsive switch in any order.

* * * * *